US006820952B2

(12) United States Patent
Austin et al.

(10) Patent No.: US 6,820,952 B2
(45) Date of Patent: Nov. 23, 2004

(54) HINGED PANEL FOR AIR HANDLER CABINET

(75) Inventors: Michael W. Austin, McMinnville, TN (US); Christian C. Herbeck, Manchester, TN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/904,676

(22) Filed: Jul. 13, 2001

(65) Prior Publication Data

US 2003/0011290 A1 Jan. 16, 2003

(51) Int. Cl.[7] ..... A47B 77/08

(52) U.S. Cl. ..... 312/326; 312/265.1

(58) Field of Search ..... 312/326, 109, 312/138.1, 296, 36, 405, 236, 263, 264, 265.5, 265.6, 401, 321.5, 293.2, 257.1; 62/331, 440, 449; 52/736.3, 405.4, 407.3; 138/149, 155, 158; 49/68, 483.1, 489.1, 493.1, 496.1, 499.1

(56) References Cited

U.S. PATENT DOCUMENTS

| | | | | |
|---|---|---|---|---|
| 2,180,177 A | | 11/1939 | Ternstrom | |
| 3,019,486 A | * | 2/1962 | Stinson | 264/239 |
| 3,635,536 A | * | 1/1972 | Lackey et al. | 312/321.5 |
| 4,134,626 A | * | 1/1979 | Kordes | 312/296 |
| 4,656,795 A | | 4/1987 | Albrecht et al. | |
| 4,875,745 A | * | 10/1989 | Trulaske | 312/109 |
| 4,955,675 A | * | 9/1990 | Donaghy | 312/321.5 |
| RE34,393 E | * | 9/1993 | McIlwraith | 312/265.4 |
| 5,319,937 A | * | 6/1994 | Fritsch et al. | 292/DIG. 38 |
| 5,374,118 A | * | 12/1994 | Kruck et al. | 220/592.1 |
| 5,551,192 A | * | 9/1996 | Avendano et al. | 312/296 |
| 5,860,281 A | * | 1/1999 | Coffee et al. | 312/298 |
| 5,870,868 A | | 2/1999 | Kita et al. | |
| 5,915,805 A | * | 6/1999 | Lee | 292/251.5 |
| 6,000,771 A | * | 12/1999 | Wissinger et al. | 312/401 |
| 6,109,712 A | * | 8/2000 | Haworth et al. | 312/400 |
| 6,179,398 B1 | * | 1/2001 | Martin | 312/265.4 |
| 6,240,703 B1 | * | 6/2001 | Brown | 312/138.1 |
| 6,296,285 B1 | * | 10/2001 | Alvring et al. | 292/146 |
| 6,350,000 B1 | * | 2/2002 | Van Benthem et al. | 312/236 |
| 6,401,478 B2 | * | 6/2002 | Dasher et al. | 312/291 |
| 6,418,672 B1 | * | 7/2002 | Hampel | 52/79.1 |
| 6,497,256 B1 | * | 12/2002 | Adams et al. | 138/149 |
| 6,530,630 B2 | * | 3/2003 | Herbeck et al. | 312/265.4 |

FOREIGN PATENT DOCUMENTS

| | | |
|---|---|---|
| DE | 1917949 | 10/1970 |
| DE | 4222971 A1 | 1/1994 |
| EP | 0038015 A2 | 10/1981 |
| GB | 1127308 | 9/1968 |
| NL | 1014208 | 7/2001 |
| WO | 01/50068 A1 | 7/2001 |

* cited by examiner

*Primary Examiner*—Carl D. Friedman
*Assistant Examiner*—Jennifer E. Novosad
(74) *Attorney, Agent, or Firm*—Wall Marjama & Bilinski LLP

(57) ABSTRACT

An air handling unit (AHU) includes a frame structure and panels that are assembled to provide ducting for handling air. Some panels include a living hinge which is one-piece with a panel perimeter. The living hinge is mounted onto side pieces of the frame structure and latched with a latching mechanism. A hollow compressible seal is attached to the side pieces such that closing and latching the hinged panels provides a sealing fit between the hinged panel and the frame structure.

2 Claims, 3 Drawing Sheets

HINGED PANEL FOR AIR HANDLER CABINET

FIELD OF THE INVENTION

This invention relates generally to the field of air handling, and more particularly to a hinged panel in an air handler cabinet.

BACKGROUND OF THE INVENTION

Many air handling units in the prior art are simply fabricated from sheet metal ducts that are brought together in the field to establish an enclosed flow path through which air is conducted. The sheet metal walls of the ducts readily conducts heat and provide little in the way of a thermal barrier so that energy flows into or out of the duct work. When the air handling unit is conducting conditioned air, this flow of energy into or out of the duct work is costly and places an unwanted load on the air conditioning equipment.

In addition, when the air handling unit is installed in an unconditioned space and is carrying cooled air, the outer casing of the unit "sweats." The moisture so developed runs off the unit onto the floor or equipment contained in the unconditioned space. This in turn leads to a safety hazard for people working in the area and causes damage to the equipment.

The traditional method for attaching AHU panels to each other is to use mechanical fasteners such as screws that are time consuming to remove and install, prone to getting lost and can strip out. Removal of the panels for equipment installation and maintenance is time consuming and does not allow complete access to the unit's interior. Other similar panel retention designs place the retainer within the panel. If the retainer fails and requires replacement, the entire panel must then be replaced. Placing the retainer within the panel also places the retainer in the inner conditioned air stream, leading to external sweating or the use of expensive composite retainers to avoid sweating.

Occasionally, air handling equipment which is placed inside the AHU needs servicing. Frequently, simply removing a panel does not provide enough access for the necessary servicing. Since one of the purposes of this new AHU is to eliminate traditional mechanical fasteners such as screws whenever possible, a structure providing easy access to the interior of the AHU for servicing is needed.

SUMMARY OF THE INVENTION

Briefly stated, an air handling unit (AHU) includes a frame structure and panels that are assembled to provide ducting for handling air. Some panels include a living hinge which is one-piece with a panel perimeter. The living hinge is mounted onto side pieces of the frame structure and latched with a latching mechanism. A hollow compressible seal is attached to the side pieces such that closing and latching the hinged panels provides a sealing fit between the hinged panel and the frame structure.

According to an embodiment of the invention, an air handling unit includes a frame structure which includes a plurality of side pieces; a hinged panel which fits into a corresponding opening in said frame structure; and a living hinge on said hinged panel connectable to one of said side pieces.

According to an embodiment of the invention, a hinged panel for an air handling unit includes first and second covers; a panel perimeter, wherein said first cover and said second cover are held in spaced apart relationship with plastic foam entirely filling a cavity thus formed between said first and second covers and said panel perimeter; and a living hinge connected to said panel perimeter.

DETAILED DESCRIPTION OF THE PREFERRED EMBODIMENT

Figure 1:
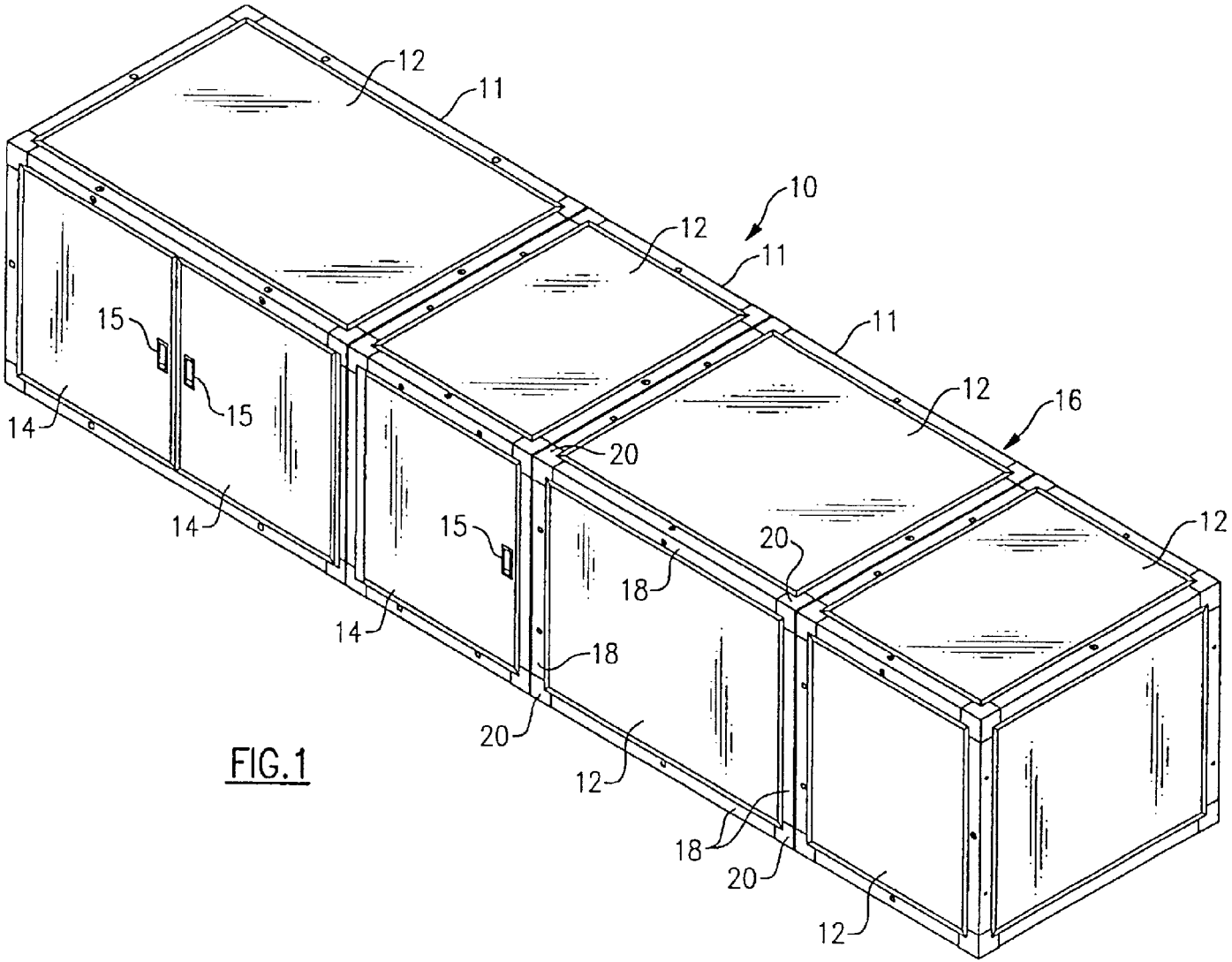
FIG. 1 shows a perspective view of a section of duct work for conducting air along a desired flow path, with some panels employing an embodiment of the present invention.
Figure 2:
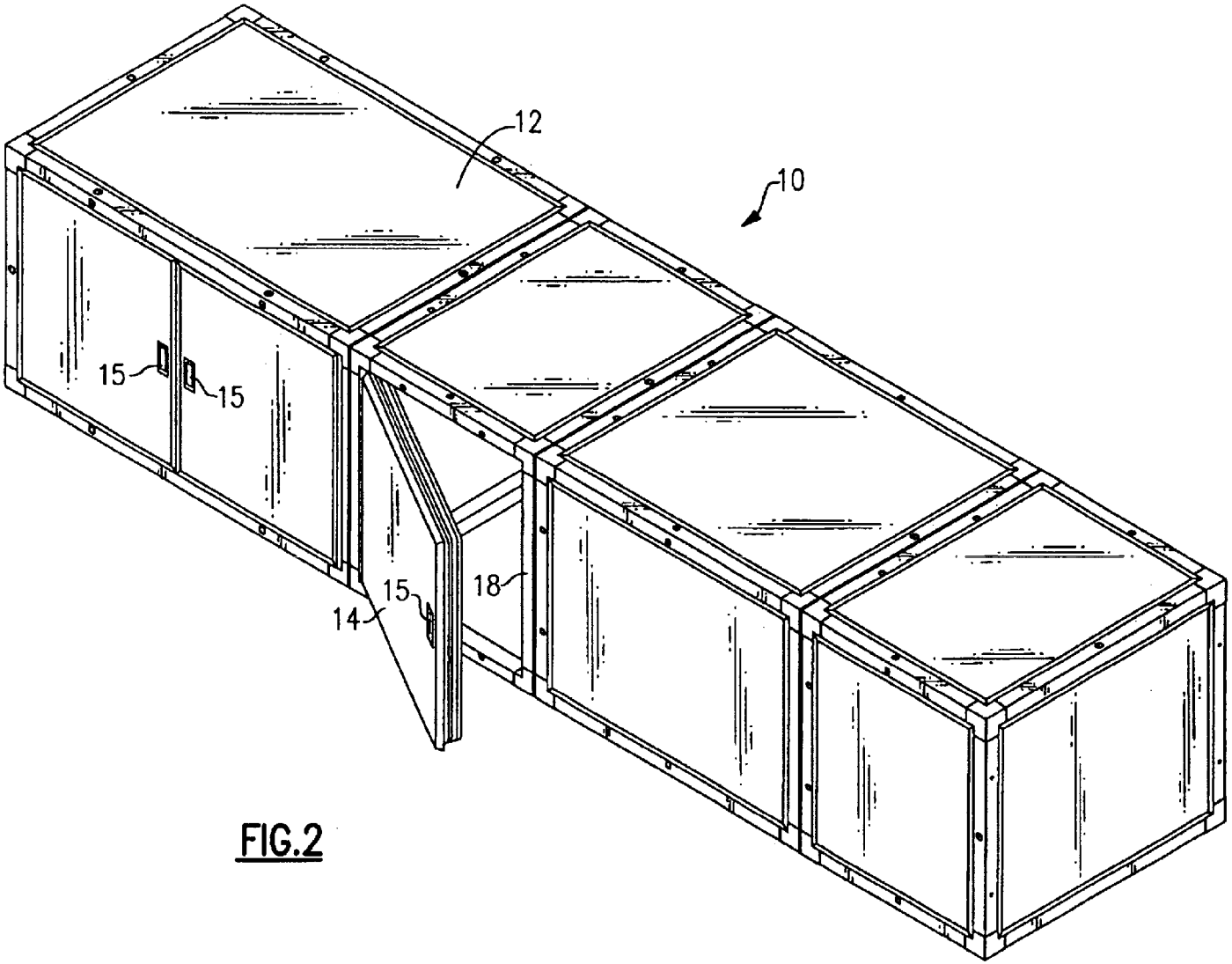
FIG. 2 shows a perspective view of a panel of the duct work of FIG. 1 which employs an embodiment of the present invention, with the panel in an open position.

Referring to FIGS. 1–2, a section of an air handling unit (AHU) 10 employs a plurality of preferably rectangular wall panels 12 which are connected to a frame structure 16 comprised of a series of three dimensional frames 11. Frame structure 16 includes a plurality of side pieces 18 which are connected to each other by a plurality of corner pieces 20. Hinged wall panels 14 are used instead of wall panels 12 when easy access to the interior of AHU 10 is required. One hinged wall panel 14 is shown in the open position in FIG. 2. A latch 15 holds hinged wall panel 14 closed by interacting with side piece 18 or another latch 15 on an opposing wall panel 14 as shown in FIG. 1.

Figure 3:
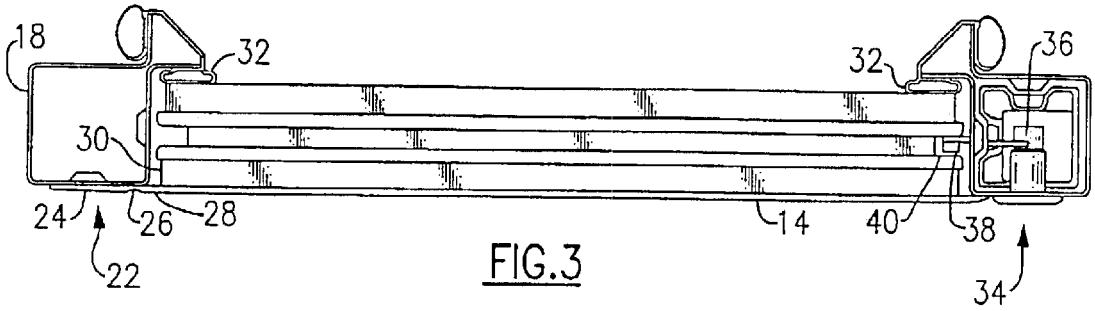
FIG. 3 shows a partial top view of the panel of FIG. 2 in the closed position.
Figure 4:
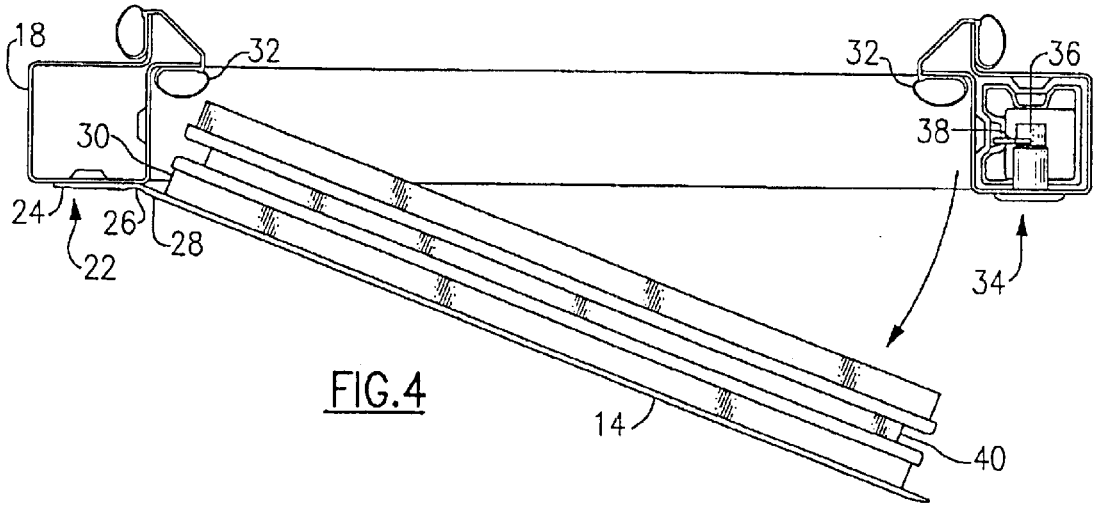
FIG. 4 shows a partial top view of the panel of FIG. 3 in the open position.

Referring to FIGS. 3–4, hinged wall panel 14 includes a living hinge 22 which in turn includes a mounting flange 24 for mounting panel 14 onto side piece 18, a hinge portion 26 which bends without breaking, and an edge extrusion 28 which connects living hinge 22 to a panel perimeter member 30. A seal 32, preferably hollow and compressible, is affixed to side pieces 18. When wall panel 14 is closed, as shown in FIG. 3, panel 14 compresses seal 32 to form a sealing fit with side pieces 18. An optional latching mechanism 34 for wall panel 14 includes a tumbler 36 which rotates a leg 38 into and out of a recess 40 in panel perimeter member 30, in which case latch 15 is merely used to pull open wall panel 14 instead of having a latching ability or function. Tumbler 36 is preferably rotated using an Allen wrench (not shown). A plurality of identical latching mechanisms 34 are preferably contained within each side piece 18 to secure all sides of wall panels 12 and all sides of hinged wall panels 14 not connected to side piece 18 via living hinge 22.

Figure 5:
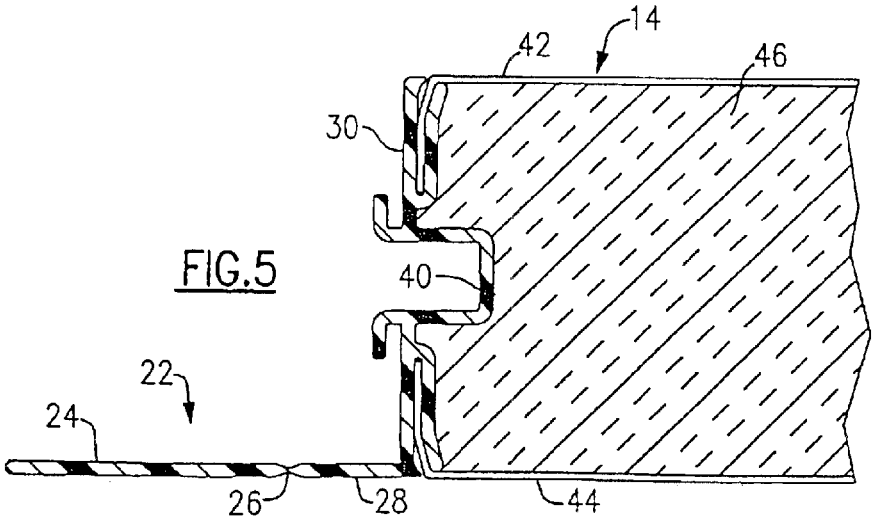
FIG. 5 shows a partial sectional view of the panel of FIGS. 3 and 4.

Referring to FIG. 5, living hinge 22 is shown in more detail. Living hinge 22 is preferably one-piece with panel perimeter member 30. Panel perimeter member 30 is shaped to hold first and second sides 42, 44 of wall panel 14 is specified distance apart. An interior 46 of wall panel 14 is preferably filled with a curable polyurethane foam which adhesively connects first and second sides of wall panel 14 to panel perimeter member 30. First and second sides are preferably of sheet metal, while panel perimeter member 30 is of a material such as nylon reinforced plastic or other plastic which has low thermal conductivity but retains enough flexibility so that repeated uses of living hinge 22 does not cause cracking or breaking of hinge portion 26.

As best illustrated in FIGS. 1, 2 and 5, when the inner surface panels are placed in sealing contact against the collapsable seals and latched in place, the outer surfaces of the panels are substantially flush with the outside surfaces of the frame pieces.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. An air handling unit that includes:

a series of three dimensional frames that are connected to form a passage for conducting air;

each frame having side pieces partially defining rectangular openings in a top, bottom and two side sections;

a panel mounted in each of said openings for closing said openings, each of said panels including a front and back cover that are held in spaced apart relationship by a panel perimeter member and a foam material filling the space between the front cover and the back cover;

each of said side pieces having a compressible seal affixed thereto, and arranged to be compressed against an inside surface of a panel when an outer surface of said panel is flush with an outer surface of the frame thereby sealing said panel in a respective opening;

at least one of said panels being connected to a side piece of one frame opening by a living hinge so that the hinged panel can move between an open position and a closed position within said one frame opening, said living hinge including an edge extrusion that is integrally formed with said hinged panel perimeter member, a mounting flange connected to said side piece of said frame, and a hinge section for connecting the edge extrusion and the mounting flange together; and a latching means for securing said hinged panel in said closed position within said one frame opening wherein said hinged panel is locked in sealing contact with a seal.

2. The air handling unit of claim 1 wherein a second hinged panel is connected by a living hinge to a second end piece of the one frame opening and wherein said latching means is arranged to act between the two hinged panels to secure the hinged panels in the closed position.

* * * * *